US008938998B2

(12) United States Patent
Haber

(10) Patent No.: US 8,938,998 B2
(45) Date of Patent: Jan. 27, 2015

(54) LOCK WITH MAGNETICALLY ACTUATED LATCH MOVEMENT PREVENTING MEMBER

(75) Inventor: Greg Haber, Woodbury, NY (US)

(73) Assignee: Babaco Alarm Systems, Inc., Moonachie, NJ (US)

( * ) Notice: Subject to any disclaimer, the term of this patent is extended or adjusted under 35 U.S.C. 154(b) by 0 days.

(21) Appl. No.: 13/568,188

(22) Filed: Aug. 7, 2012

(65) Prior Publication Data

US 2014/0041421 A1 Feb. 13, 2014

(51) Int. Cl.
*E05B 65/08* (2006.01)
*E05B 47/00* (2006.01)

(52) U.S. Cl.
USPC ..... 70/95; 70/100; 70/276; 292/251.5

(58) Field of Classification Search
USPC ..... 70/276, 413, 95, 99, 100; 292/251.5
See application file for complete search history.

(56) References Cited

U.S. PATENT DOCUMENTS 2,050,696 A * 8/1936 Schoorel ..... 70/95
2,322,040 A * 6/1943 Maruri ..... 70/145
3,270,536 A * 9/1966 Sprung ..... 70/89
3,599,452 A * 8/1971 Maruyama et al. ..... 70/200
3,893,722 A * 7/1975 Galbreath et al. ..... 292/100
4,126,025 A * 11/1978 Miyamae ..... 70/360
4,370,874 A * 2/1983 Munn ..... 70/204
4,380,162 A * 4/1983 Woolfson ..... 70/276
4,398,404 A * 8/1983 Wake ..... 70/276
4,565,080 A * 1/1986 Kincaid et al. ..... 70/215
5,076,623 A * 12/1991 Richards ..... 292/251.5
5,188,405 A * 2/1993 Maccaferri ..... 292/204
5,485,733 A * 1/1996 Hoffman ..... 70/276
5,518,282 A * 5/1996 Sawada ..... 292/252
5,608,980 A * 3/1997 Pangerl ..... 40/793
5,701,772 A * 12/1997 Wang ..... 70/284
6,681,607 B2 * 1/2004 Geringer ..... 70/432
7,066,500 B2 6/2006 Haber
8,004,393 B2 * 8/2011 Haber ..... 340/426.28
8,397,546 B2 * 3/2013 Varney et al. ..... 70/276
2009/0115204 A1 * 5/2009 Rycroft ..... 292/341.17

* cited by examiner

*Primary Examiner* — Lloyd Gall
(74) *Attorney, Agent, or Firm* — Robert L. Epstein; Epstein Drangel LLP

(57) ABSTRACT

The lock has a rotatable latch. The latch is mounted for movement between a position wherein it engages a fixed part of the vehicle to secure the door in the closed position and a position remote from the fixed part of the vehicle such that the door can be opened. A latch movement preventing member is moveable relative to the latch between a position remote from the path of movement of the latch, wherein the latch is free to disengage the fixed part of the truck, and a position intersecting the path of the latch, wherein movement of the latch to disengage the fixed part of the truck is blocked. A pair of magnets are oriented to force the member to move from its remote position, against the action of a spring, to its intersecting position, to prevent the latch from disengaging the fixed part of the truck.

26 Claims, 5 Drawing Sheets

LOCK WITH MAGNETICALLY ACTUATED LATCH MOVEMENT PREVENTING MEMBER

BACKGROUND OF THE INVENTION

1. Field of the Invention

The present invention relates to a lock for the roll-up door of a truck or other vehicle and more particularly to such a lock that includes a magnetically actuated latch movement preventing member.

2. Description of Prior Art Including Information Disclosed Under 37 CFR 1.97 and 1.98

Many vehicles, particularly trucks and trailers, have roll-up doors that permit entrance into the truck interior for the loading and unloading cargo. Locking devices of different types have been used to secure such roll-up doors in the closed position, to prevent unauthorized access to the truck interior. Locks of the type of the present invention are commonly used for that purpose.

The lock mechanism is situated in a heavy duty rectangular metal housing that is secured to the exterior surface of the truck door, adjacent the bottom of the door. The truck door jamb opposite the position of the lock has a recess into which a fixed part, in the form of a shaft or bar, is mounted. Within the lock housing is situated a latch mounted for rotation about an axis that extends through the housing, from the front wall of the housing to the rear wall. The latch includes a hook designed to engage the vehicle part recessed in the door jamb, when the latch is in the "closed" position.

A handle, accessible from the exterior of the housing, is connected to rotate the latch between the "closed" position, wherein the hook engages the vehicle part to secure the door to the jamb, and the "open" position where the hook is remote from the vehicle part, and the door is not secured. Also mounted within the housing is a key actuated lock cylinder. In a conventional lock of this type, the lock cylinder is rotated to permit a spring to move a member in a direction toward the front of the housing to intersect the path of the latch. In that forward position, the member blocks the rotational movement of the latch such that the hook is retained in engagement with the vehicle part in the door jamb.

In order to protect the lock, the lock cylinder is located within a strong cylindrical housing portion protruding from the front wall of the housing. However, like all locks, this type of lock can be attacked by thieves. If the perpetrator understands how the lock operates, an elongated tool, such as a screw driver, can be wedged through the key opening, along the side of the lock cylinder, and be used to push the latch movement preventing member toward the rear of lock, against the force of the spring. Moving the latch movement preventing member towards the rear wall of the lock, out of the path of movement of the latch, will defeat the lock. That is because it permits the latch to be rotated to disengage the hook from the door jamb, permitting the door to be opened.

In order to prevent this problem, and increase the security of the lock, the conventional lock was improved as described in U.S. Pat. No. 7,066,500, issued Jun. 27, 2006, which patent is incorporated herein by reference. The improved lock of the patent has a redesigned mechanism in which a spring biases the latch movement preventing member in the opposite direction, toward the rear of the lock housing, to the position in which it intersects the path of movement of the latch. With this modification, even if a tool is inserted into the housing, and beyond the lock cylinder, the latch movement preventing member cannot be pushed out of the path of the latch to permit the latch to rotate. That modification significantly enhances the protection that the lock provides, without increasing the cost or complexity of the lock.

The present invention is a further improvement of the lock in which the latch movement presenting member is magnetically actuated to move from a position out of the path of movement of the latch to a position intersecting the path of movement of the latch. The use of magnetic force to move the latch movement preventing member results in smoother and more reliable action as compared to that of a spring.

More specifically, the latch movement preventing member, which takes the form of a piston-like member, carries a permanent magnet. A second permanent magnet is carried on a mechanical linkage which is attached to the lock cylinder. When the key is used to lock the cylinder, the linkage moves to align the magnets. The magnets are oriented such that like polarity poles face each other and a strong repulsive magnetic force is created between the magnets. That force causes the member to move from its retracted position, against the force of a spring, to its extended position, blocking the rotation of the latch, and preventing the latch from disengaging the door jamb.

It is, therefore, a prime object of the present invention to provide a vehicle door lock with a magnetically actuated latch movement preventing member.

It is another object of the present invention to provide a vehicle door lock with a magnetically actuated latch movement preventing member which has a smoother and more positive action.

It is another object of the present invention to provide a vehicle door lock with a magnetically actuated latch movement preventing member which has improved reliability.

It is another object of the present invention to provide a vehicle door lock with a magnetically actuated latch movement preventing member in which the repulsive force between magnets causes the latch movement preventing member to move into the path of movement of the latch.

BRIEF SUMMARY OF THE INVENTION

The above objects are achieved by the present invention which relates to a lock for a vehicle door. The lock includes latch means mounted for rotation between a locked position, where the latch means engages the door jambb of the vehicle and an unlocked position where the latch means is remote form the door jambb. A latch movement preventing member is moveable between a position remote from the path of movement of the latch means, in which the latch means is free to move to disengage the door jambb, and a position intersecting the path of the latch means to prevent movement of the latch means. Magnetic means are provided for moving the member from its remote position to its intersecting position.

The lock also includes spring means for biasing the member toward its remote position. The magnetic means acts against the force of the spring as the latch movement preventing member is moved from its retracted position to its extended position.

The magnetic means includes a first magnet associated with the member and a second magnet. The first magnet and the second magnet have poles of the same polarity and are oriented such that the poles of the same polarity face each other when the magnets are aligned. The member is urged toward its intersecting position by the repulsive force developed between first and second magnets.

The spring urges the member toward its remote position. When the magnets are not aligned, the spring causes the member to move toward its remote position.

The lock also includes a lock cylinder and a mechanical linkage attached to and moveable with the lock cylinder. One of the magnets is mounted on and movable with the linkage.

The other magnetic is mounted on and moveable with the member. The magnets are aligned when the lock cylinder is moved to its locked position.

The member has an internal compartment. One of the magnets is situated within the compartment in the member.

The latch means rotates about an axis. The member moves in a direction substantially parallel to the axis of latch means rotation.

The lock has a housing with a rear wall. The member is in its intersecting position when it is proximate the rear wall of the housing. The member is in its remote position when it is remote from the rear wall of the housing.

A sensor is associated with the member to sense the position of the member. The sensor is connected to a circuit that provides a visual indication of the position of the member.

In accordance with another aspect of the present invention, a lock is provided for a vehicle having a door and a fixed part proximate the door. The lock has a housing attached to the vehicle door. Latch means are provided, including a hook. The latch means is mounted in the housing for movement between a position wherein the hook engages the fixed part of the vehicle to secure the door in the closed position and a position wherein the hook is remote from the fixed part such that the door can be opened. A latch movement preventing member is provided for movement relative to the housing between a position remote from the path of movement of the latch means, wherein the latch means is free to move, and a position intersecting the path of the latch means, wherein movement of the latch means to disengage the hook from the fixed part is blocked. Magnetic means are provided for moving the member from its remote position to its intersecting position.

BRIEF DESCRIPTION OF THE SEVERAL VIEWS OF DRAWINGS

To these and to such other objects that may hereinafter appears, the present invention relates to a lock with a magnetically actuated latch movement preventing member as described in detail in the following specification and recited in the annexed claims, taken together with the accompanying drawings, in which like numerals refer to like parts and in which:

DETAILED DESCRIPTION OF THE INVENTION

Figure 1:
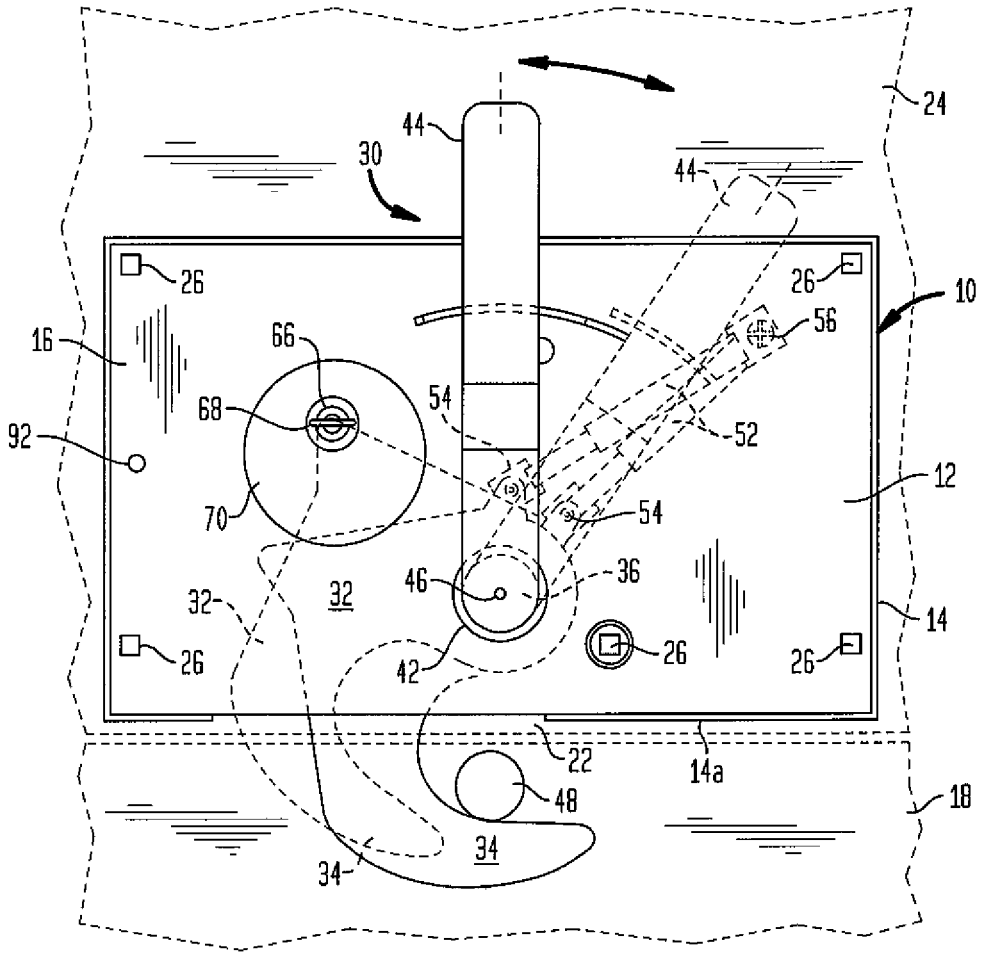
FIG. 1 is a front elevation view of the lock of the present invention, as it would appear mounted on a vehicle door.

As seen in the drawings, the lock of the present invention includes a housing, generally designated 10 consisting of a front wall 12, from which side walls 14 extend rearwardly, and a rear wall 16. The side wall 14*a* that faces the door jamb 18 of the vehicle has an opening 22 through which a hook 34 extends.

Housing 10 is fabricated of strong, heavy metal and is designed to be mounted on the exterior surface of a vehicle door 24 by means of a plurality of smooth headed bolts (not shown) that extend through openings 26 in housing front wall 12, openings 28 in housing rear wall 16 and through vehicle door 24 such that the nuts for those bolts are not accessible form the exterior of the door.

Latch 30 includes a latch body 32 which is integral with a hook 34. Latch body 32 is mounted on a large diameter shaft 36 situated within the housing. Shaft 36 is rotatably received at its rear within an opening in housing rear wall 16 and at its front by an opening in housing front wall 12 defined by a collar 42 extending from the surface housing front wall 12. Shaft 36 rotates about axis 46.

A handle 44 is fixed to the front surface of shaft 36. Shaft 36, and hence latch body 32, rotates about axis 46, which extends in a direction that is orthogonal with respect to the front wall 12 and rear wall 16 of the lock. As indicated by the arrows in FIG. 1, latch body 32 rotates in a clockwise direction as handle 44 is moved through an arc from a vertical position (seen in solid), where hook 34 engages part 48 in the vehicle door jamb 18, to a position (seen in phantom) where hook 34 is remote and disengaged from vehicle part 48.

A spring 52, is pivotally connected between latch body 32, by pin 54, and housing front wall 12, by screw 56. Spring 52 biases latch body 32 towards the disengaged position of hook 34, shown in phantom in FIG. 1.

Figure 2:
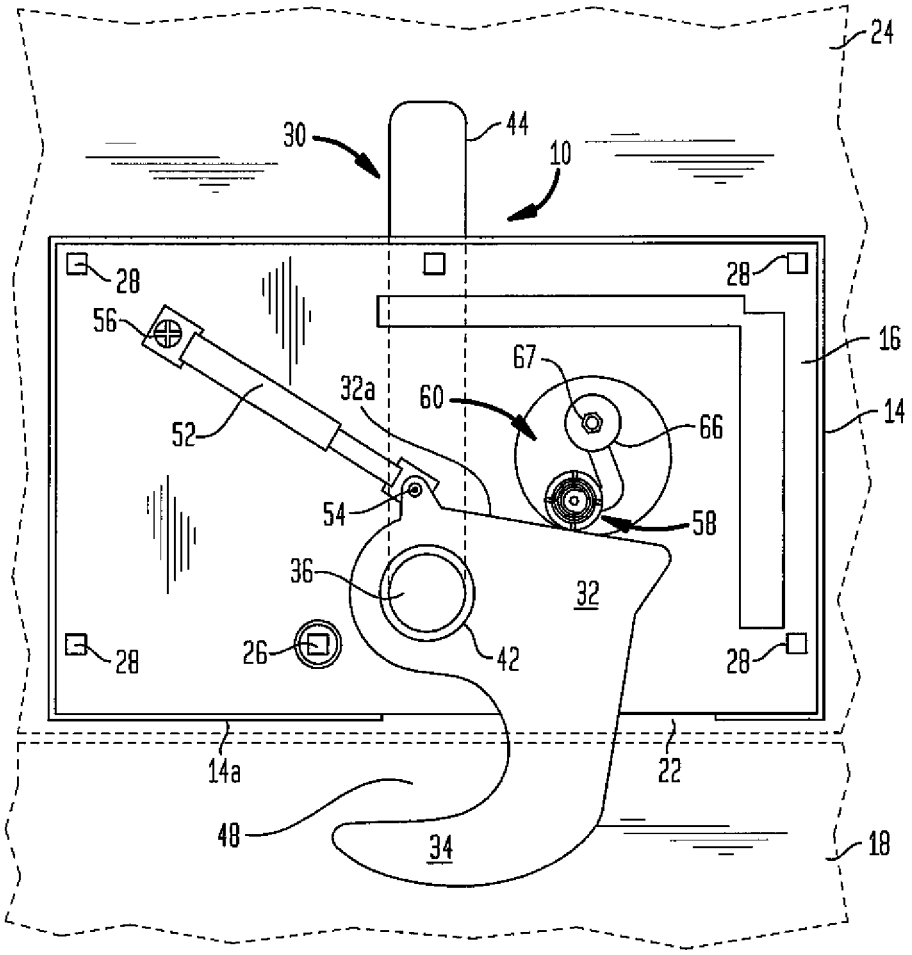
FIG. 2 is a rear view of the interior of the lock, showing the rotational position of the latch with the hook in the engaged position.

As best seen in FIG. 2, a latch movement preventing means 58 is provided. Means 58 includes a cylindrically shaped piston-like member 76 which is linearly moveable along an axis substantially parallel to the latch rotation axis 46, into and out of the path of movement of latch 30.

The latch movement preventing means 58 is situated within a portion of the front wall 12 which protrudes from the front wall and has a front plate 70. Member 76 has an internal, generally cylindrical compartment or recess 40 which is open to the surface of the member which faces the rear surface of front plate 70.

The housing of a lock cylinder 66 is situated within the protruding portion of the front wall and is mounted to front plate 70. The lock cylinder is rotated within its housing by a key 68. Cylinder 66 is connected to latch movement preventing means 58 by a mechanical cam linkage 71. Linkage 71 causes member 76 to move into and out of the path of movement of latch 30 in accordance with the rotation of lock cylinder 66.

Figure 3:
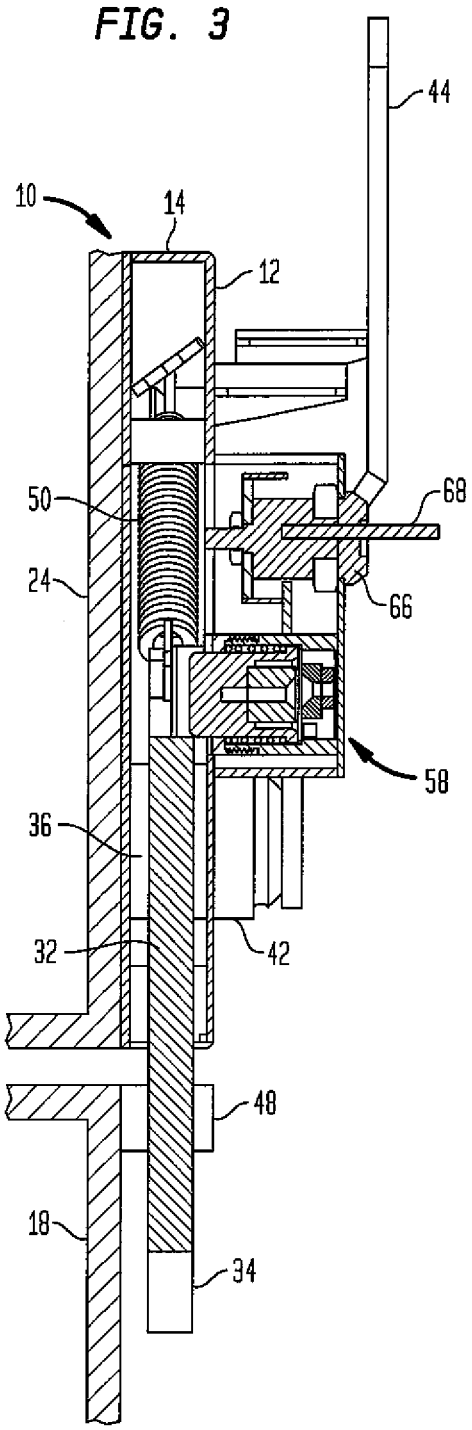
FIG. 3 is a side cross-sectional view of the lock.
Figure 4:
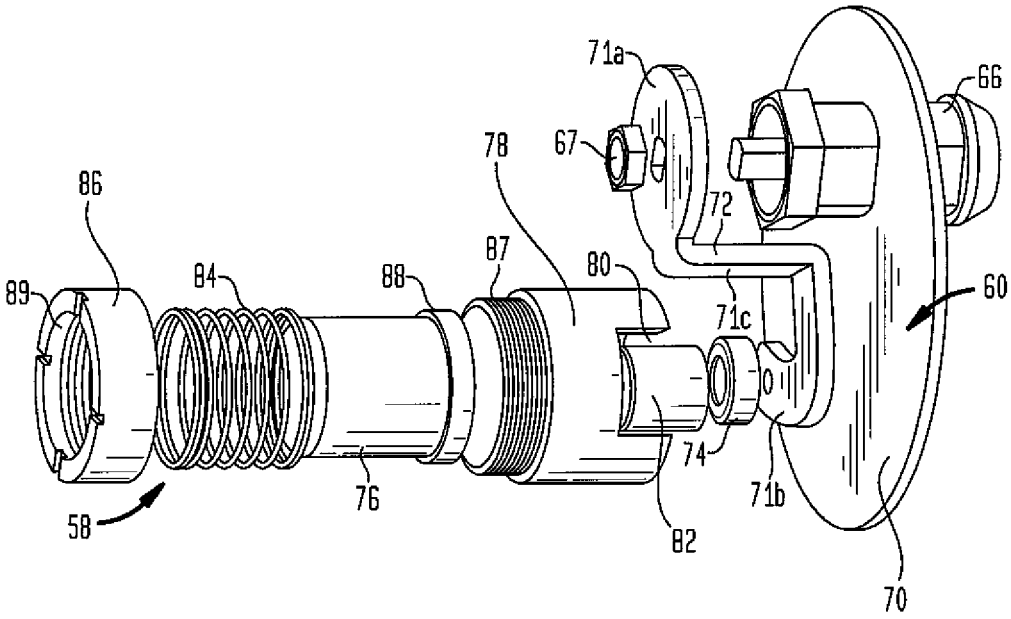
FIG. 4 is a prospective exploded side view of the lock cylinder, cam linkage, magnet and latch movement preventing member.
Figure 5:
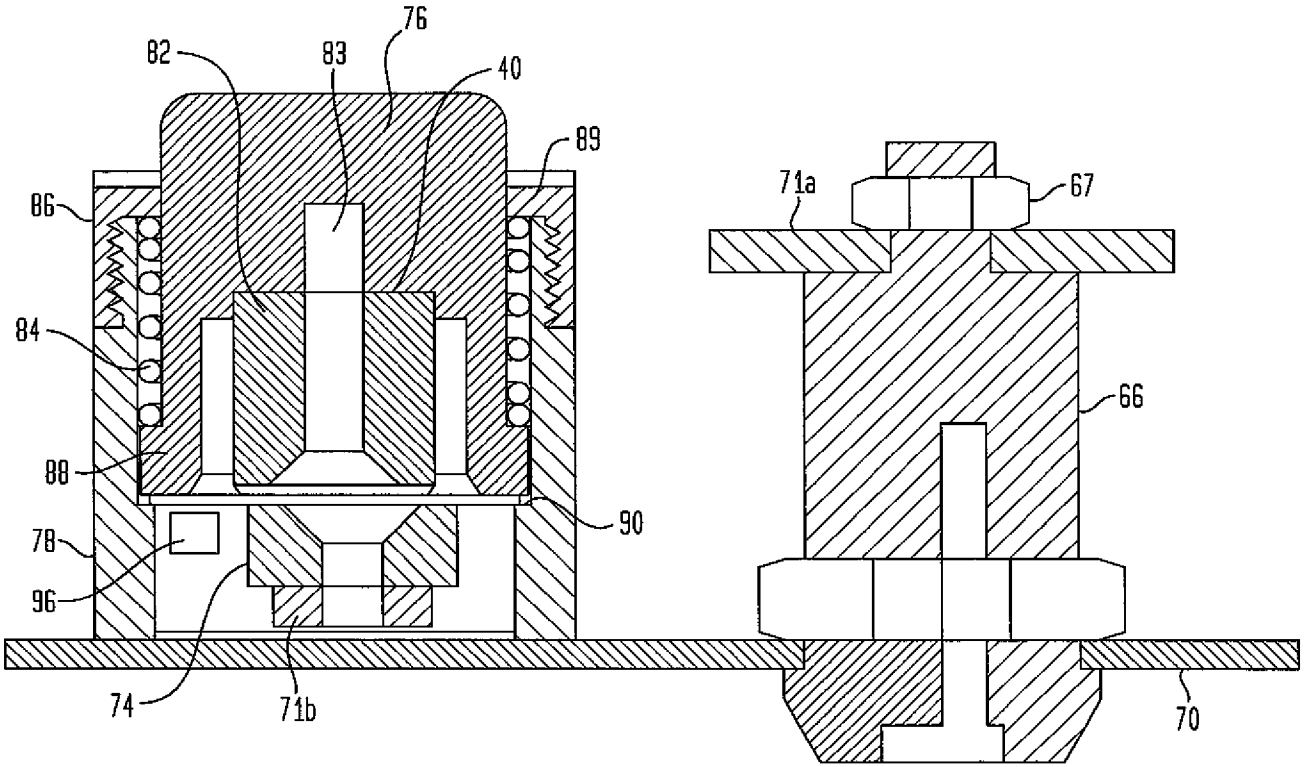
FIG. 5 is a cross-sectional of the components of FIG. 4, showing the components assembled, and the latch movement preventing member in its retracted position.

As best seen in FIGS. 3, 4 and 5, cam linkage 71 includes a part 71*a* parallel to but remote from front plate 70 which is fixed to a threaded shaft extending from the rear of cylinder 66 by a cam nut 67. Linkage 71 also includes a part 71*b* which is situated parallel to but near front plate 70. Part 71*b* is connected to part 71*a* by an intermediate linkage part 71*c* which extends in a direction generally perpendicular to front plate 70. Part 71*b* of the linkage moves in a small arc about the axis of lock cylinder 66, as the lock cylinder 66 is rotated by key 68.

Affixed to the surface of part 71*b* is a generally cylindrical permanent magnet 74. As linkage 71 moves, magnet 74 is moved into and out of alignment with the axis of member 76.

Member 76 is situated in and moveable relative to a hollow housing or collar 78 which is fixed to the rear surface of front plate 70. Housing 78 has a side access opening 80 situated at the end of the housing which is attached to front plate 70.

A second generally cylindrical permanent magnet 82 is mounted within the internal compartment 40 of member 76 by a screw 83. Magnet 74 and magnet 82 are oriented such that when aligned the magnets interact to urge member 76 to move away from front plate 70 and thus to a position intersecting the path of movement of latch 30 to prevent the latch body from being rotated to a position where hook 34 disengages fixed part 48 on the truck jamb.

Member 76 carries an outwardly extending ring-like member or flange 88 fixed on the end of the member 76 closest to front plate 70. Member 88 forms a lip upon which one end of a spring 84 rests. Spring 84 surrounds member 76. An internally threaded spring retention nut 86 mates with the external threads of housing 78 to capture spring 84 between the lip of member 88 and the inwardly extending rim 89 of nut 86.

Member 76 is movable within housing 78, in a direction generally parallel to axis 46 of latch shaft 36, between a retracted position (shown in FIG. 5) and an extended position (shown in FIG. 3). The retracted position is remote from the path of movement of latch 30. In that position, the edge of the end of member 76 facing front plate 70 rests on a circumferential shoulder 90 formed within housing 78. In the extended position, a portion of member 76 is situated far enough beyond the surface of nut 86 to intersect the path of movement of latch 30.

Spring 84 urges member 76 towards its retracted position. It also serves to limit the distance that member 76 can travel beyond nut 86 in the extended position as it is compressed by the movement of member 76 toward the extended position.

As is best seen in FIG. 5, in the retracted position, the end of member 76 facing front plate 70 is spaced from the front plate, such that there is always a gap between member 76 and the front plate. That gap is aligned with access opening 80 in member 76. Opening 80 permits magnet 74, situated on linkage 71, to move in and out of the gap, and thus into and out of alignment with magnet 82 situated within member 76.

Like all permanent magnets, each of the magnets 74 and 82 has two opposite polarity poles. The magnets will attract each other when the opposite polarity poles face each other. The magnets will repulse each other when poles of the same polarity face each other. In the lock, magnets 74 and 82 are oriented such that poles of the same polarity are facing each other. Accordingly, a strong repulsive magnetic force is created between magnets 74 and 82 when the magnets are aligned. That repulsive magnetic force urges member 76 away from front plate 70 and toward its extended position, against the action of spring 84. When the magnets are out of alignment, the force applied on member 76 by spring 84 causes member 76 to move to its retracted position.

Thus, the position of member 76 is determined by the position of lock cylinder 66. Rotation of lock cylinder 66 to its locked position causes linkage 71 to rotate and magnet 74 to move into the gap between member 76 and front plate 70, through opening 80 in housing 78. In that position, magnet 74 aligns with magnet 82 and the repulsive magnetic force created by the magnets overcomes the force of spring 84 and causes member 76 to move to its extended position, compressing spring 84 and blocking the rotation of the latch.

When the lock cylinder 66 is rotated to its unlocked position, linkage 71 rotates such that magnet 74 is no longer aligned with magnet 82. In that position, the repulsive magnetic force of the magnets no longer acts on member 76 and spring 84 moves member 76 to its retracted position. In the retracted position, member 76 no longer prevents latch 30 from rotating, and the latch can be rotated to a position where hook 34 no longer engages part 48 of the door jamb of the truck. That allows the truck door to be opened.

A limit switch 96 is situated in the gap between member 76 and front plate 70 and senses when member 76 is in the retracted position. The limit switch is connected to an electrical circuit including a battery (not shown) and a lamp 92, preferably an LED, visible from the front wall of the lock, see FIG. 1. LED 92 is energized by the battery to provide a visible indication of the state of the lock. That circuit can also be connected to the theft alarm system on the truck such that the alarm system will generate an alarm signal if the lock is attacked and the member 76 is moved to its retracted position while the alarm system is armed.

It will now be appreciated that the present invention relates to a lock for a truck door having a rotatable latch which can be moved to engage the door jamb of the truck to lock the door. The lock has a member which, in its extended position, prevents the latch from rotating to a position where the door jamb is disengaged. The latch movement preventing member is moveable from its extended position to a retracted position, where it is remote from the path of movement of the latch. In the retracted position of the member, the latch can rotate to disengage the door jamb, such that the door can be opened.

The latch movement preventing member is spring-loaded toward its retracted position and is moved towards its extended position, against the force of the spring, by the repulsive magnetic force developed by a pair of permanent magnets. That magnetic force overcomes the action of the spring, such that the member can move toward its extended position. In the extended position, the rotation of the latch from its position engaging the door jamb is blocked, and the door cannot be unlocked.

While only a single preferred embodiment of the present invention has been disclosed for purposes of illustration, it is obvious that many variations and modifications could be made thereto. It is intended to cover all of these variations and modifications that fall within the scope of the invention, as defined by the following claims:

I claim:

1. A lock for a vehicle door, the lock comprising: a latch mounted for movement between a locked and an unlocked position; a latch movement preventing member moveable between a position remote from the path of movement of said latch and a position intersecting the path of said latch to prevent movement of said latch; a mechanical lock cylinder, a mechanical linkage connected to said lock cylinder and moveable between a position proximate said member and a position remote from said member in response to the actuation of said lock cylinder and a magnet operably interposed between said member and said linkage for moving said member from said remote position to said intersecting position, preventing said latch from being moved from said locked position to said unlocked position, as said mechanical linkage is moved to said proximate position.

2. The lock of claim 1 further comprising a spring which urges said member toward said remote position.

3. The lock of claim 1 wherein said magnet comprises a first magnet associated with said member.

4. The lock of claim 3 wherein said magnet further comprises a second magnet associated with said linkage.

5. The lock of claim 4 wherein said first magnet and said second magnets have poles of the same polarity.

6. The lock of claim 4 wherein said member is urged toward said intersecting position by said first and second magnets, when said linkage is in said proximate position.

7. The lock of claim 4 wherein said first and second magnets create a repulsive force when the same polarity poles thereof are proximate to each other and wherein said member is urged toward said intersecting position by the repulsive force of said first and second magnets, when said linkage is moved to said proximate position.

8. The lock of claim 6 further comprising a spring which urges said member toward said remote position.

9. The lock of claim 6 further comprising a spring which urges said member toward said remote position, when said linkage is in said remote position.

10. The lock of claim 1 wherein said magnet comprises a first part and a second part and wherein at least one of said parts is movable with said linkage.

11. The lock of claim 1 wherein said magnet comprises a first part and a second part, at least one of which is moveable with said member.

12. The lock of claim 10 wherein the other part of said magnet is moveable with said member.

13. The lock of claim 12 wherein said first part of said magnet and said second part of said magnet are remote from each other when said mechanical linkage is in said remote position.

14. The lock of claim 1 wherein said member has an internal compartment and wherein at least a part of said magnet is situated within said compartment.

15. The lock of claim 12 wherein said mechanical lock cylinder has a locked state and wherein said first part of said magnet and said second part of said magnet are proximate each other when said mechanical lock cylinder is in said locked state.

16. The lock of claim 1 wherein said latch rotates about an axis and wherein said member moves in a direction substantially parallel to said axis of said latch rotation.

17. The lock of claim 16 wherein said lock has a housing with a rear wall and wherein said member is in said intersecting position when it is proximate to said rear wall of said lock housing.

18. The lock of claim 16 wherein said lock has a housing with a rear wall and wherein said member is in said remote position when it is remote from said rear wall of said lock housing.

19. The lock of claim 18 further comprising a spring which urges said member toward said remote position.

20. The lock of claim 1 further comprising means for sensing the position of said member and means for actuating a visible indicator in response to said sensing means.

21. A lock adapted for use on a vehicle, said lock comprising: a housing; a latch; said latch being mounted in said housing for movement between a locked position and an unlocked position; a latch movement preventing member moveable relative to said latch between a position remote from the path of movement of said latch, wherein said latch is free to move, and a position intersecting the path of said latch, wherein movement of said latch is blocked; a mechanical lock cylinder, a mechanical linkage connected to said lock cylinder and movable between a position proximate said member and a position remote from said member in response to the actuation of said lock cylinder and a magnet for moving said member from said remote position to said intersecting position as said mechanical linkage is moved to said proximate position.

22. A lock comprising: a latch mounted for movement between a locked and an unlocked position; a latch movement preventing member moveable between a position remote from the path of movement of said latch and a position intersecting the path of said latch to prevent movement of said latch; and first and second magnets, said first and second magnets having poles of the same polarity situated to create a repulsive force for moving said member from said remote position to said intersecting position, thereby preventing said latch from being moved from said locked position to said unlocked position.

23. The lock of claim 22 further comprising a spring for urging said member towards said remote position.

24. The lock of claim 22 further comprising means for moving said first and second magnets between a proximate position wherein said repulsive force is sufficient to move said member and a remote position wherein said repulsive force is not sufficient to move said member.

25. The lock of claim 24 further comprising a spring for urging said member towards said remote position, wherein said repulsive force created when said first and second magnets are in said proximate position is sufficient to overcome the urging of said spring.

26. The lock of claim 24 further comprising a spring for urging said member towards said remote position, wherein said repulsive force created when said first and second magnets are in said remote position is insufficient to overcome the urging of said spring.

* * * * *